US006422328B1

(12) United States Patent
Holland et al.

(10) Patent No.: US 6,422,328 B1
(45) Date of Patent: Jul. 23, 2002

(54) DUAL CUTTING MILL

(75) Inventors: Jimmie Joe Holland, Harrah, OK (US); Barry Boswell, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/427,816

(22) Filed: Oct. 27, 1999

(51) Int. Cl.[7] ..... E21B 4/16; E21B 10/12

(52) U.S. Cl. ..... 175/398; 166/55.6; 175/96; 175/108

(58) Field of Search ..... 166/55, 55.6; 175/74, 175/95, 96, 107, 108, 113, 319, 341, 365, 398

(56) References Cited

U.S. PATENT DOCUMENTS

| | | | | | |
|---|---|---|---|---|---|
| 750,840 | A | * | 2/1904 | Fox | 175/96 |
| 1,417,363 | A | * | 5/1922 | Wadsworth | 175/319 |
| 1,551,783 | A | * | 9/1925 | Baptie | 175/319 |
| 1,814,296 | A | * | 7/1931 | Dean | 175/319 |
| 2,243,319 | A | * | 5/1941 | Ross | 175/319 |
| 2,511,831 | A | | 6/1950 | Adamson | 255/71 |
| 2,655,344 | A | * | 10/1953 | McDonald | 175/100 |
| 2,877,988 | A | | 3/1959 | Cameron et al. | 255/301 |
| 2,911,196 | A | | 11/1959 | Cameron et al. | |
| 2,975,849 | A | * | 3/1961 | Stuart | 175/333 |
| 3,161,243 | A | | 12/1964 | Davis | 175/95 |
| 3,635,296 | A | | 1/1972 | Lebourg | |
| 3,835,942 | A | * | 9/1974 | Leonardi | 175/96 |
| 3,945,445 | A | * | 3/1976 | Ikeda | 175/319 |
| 4,880,066 | A | * | 11/1989 | Steiginga et al. | 175/75 |
| 5,370,479 | A | | 12/1994 | Akesaka | 405/138 |
| 5,535,835 | A | * | 7/1996 | Walker | 175/73 |
| 5,620,056 | A | * | 4/1997 | Eppink | 175/95 |

FOREIGN PATENT DOCUMENTS

| | | | | |
|---|---|---|---|---|
| DE | 195 21 447 | | 12/1996 | |
| EP | 288123 | A2 * | 10/1988 | ..... E21B/4/02 |
| GB | 2 088 756 | | 6/1982 | |

OTHER PUBLICATIONS

Servco Catalog sheet; *Junk, Taper and String Taper Mills;* p. 3187; date and place of publication or public use unknown.

Big Hole Fishing Catalog sheet; Piranha and Deep Throat Cement Mill; one sheet; date and place of publication or public use unknown.

Baker Oil Tools Drawing No. 943; Superloy Junk Mill; one page; date and place of public use unknown Jan. 10, 1995.

Baker Oil Tools Drawing No. 945; Metal Muncher Junk Mill; one page; date and place of public use unknown Jan 2, 1996.

Baker Oil Tools Drawing No. 947; Superloy Piranha Mill; one page; date and place of public use unknown Jun. 27, 1997.

* cited by examiner

*Primary Examiner*—David Bagnell
*Assistant Examiner*—Jennifer H Gay
(74) *Attorney, Agent, or Firm*—Gerald W. Spinks

(57) ABSTRACT

A rotating tool for milling or drilling in a well bore, having one or more rotating cutting structures, with each cutting structure rotating about its own axis, and with the cutting structures rotating about the axis of the tool. The rotational axis of the tool is offset from the axis of at least one cutting structure, with the axis of the tool passing through that cutting structure. This ensures that the cutting structure which spans the axis of the tool rotates independently of the tool, to prevent the existence of a zero velocity point on the cutting face of the tool.

10 Claims, 2 Drawing Sheets

DUAL CUTTING MILL

BACKGROUND OF THE INVENTION

1. Field of the Invention

The present invention is in the field of rotating cutting tools used for milling downhole metal members in a well bore, and rotating cutting tools used for drilling a well bore through an earth formation.

2. Background Information

Various milling applications and drilling applications have, over the years, suffered from the problem of a "dead" spot in the center of the mill or drill bit. As the mill or drill bit rotates, it revolves around a central axis. At the point where that central axis passes through the cutting face of the mill or drill bit, the cutting structure is degraded and quickly becomes ineffective. Ultimately, a core, or depression, is worn into the cutting matrix. As the core wears further into the matrix, fluid circulation in the area is reduced, and cuttings resulting from the milling or drilling operation are no longer effectively removed. The reason for this problem is that on the cutting face, at the point where the central axis passes through the cutting face, the cutting elements have essentially a zero cutting surface speed.

In a typical milling situation, for instance, a segment of metal tubing may be stuck in the well bore. The tubing will usually be bent and leaning against the sides of the casing or well bore. In this situation, a rotating metal milling tool will typically be run downhole to mill away the bent metal tubing. As the milling tool progresses downwardly, milling away the bent tubing, there will be a number of times when the wall of the bent tubing is positioned against the center of the face of the milling tool. This results in a zero relative speed of the cutting elements across the bent tubing at the center point, with little effective cutting taking place. This generates considerable heat at the center point, which can soften the cutting matrix, leading to rapid deterioration of the matrix at the center point. Ultimately, this can create a deep depression or cone in the center of the face of the milling tool. When the depression deepens to the point of reaching the body of the milling tool, which is typically made of steel, no further milling progress can be made.

A similar problem can occur in the drilling of a well bore through an earth formation. Coning of the drill bit can occur at the center point, resulting in slowing or even stalling of drilling progress, requiring the drilling operation to be stopped until a new bit is installed. It is the object of the present invention to provide a design, which can be incorporated into either a milling tool or a drill bit, which will not have a zero cutting speed anywhere on the cutting face of the tool, thereby eliminating the coning problem and allowing a full depth milling or drilling operation to be accomplished.

BRIEF SUMMARY OF THE INVENTION

Whether embodied in a milling tool or a drill bit, the tool of the present invention has a cutting assembly consisting of one or two cutting structures, with at least one of the cutting structures being rotated about an axis offset from the axis of the borehole. The tool is connectable to the lower end of a drill string or coiled tubing, for positioning in a well bore. Use of the term "drill string" herein is intended to include all types of tubular strings, including coiled tubing, where the context allows. The cutting assembly as a whole rotates about its longitudinal axis. Further, each of the cutting structures rotates about its own longitudinal axis. The longitudinal axis of at least one cutting structure is offset from, but parallel to the longitudinal axis of the cutting assembly, and this cutting structure spans the longitudinal axis of the cutting assembly. Therefore, as the cutting assembly rotates, the offset cutting structure rotates independently, insuring that the center point of the cutting assembly does not have a zero cutting surface speed. This prevents coning of the cutting structures at the center point. Where a second cutting structure is present in the cutting assembly, it can also have an offset axis, or its axis can coincide with the axis of the cutting assembly.

In one embodiment, the cutting assembly can be mounted on the lower end of a housing connected to a drill string or coiled tubing, with a first cutting structure being fixedly mounted to the housing and a second cutting structure rotatably mounted to the housing. The rotational axis of the first cutting structure coincides with the axis of the housing, while the rotational axis of the second cutting structure is offset from the axis of the housing. In this embodiment, the first cutting structure is rotated by rotation of the housing, while the second cutting structure is independently rotated by a drill motor mounted within the housing. Rotation of the cutting assembly as a whole is accomplished by rotating the drill string to rotate the housing and cutting assembly, or by rotation of the housing and cutting assembly with a drill motor. The cutting assembly can be centered on the axis of the well bore or casing within which the apparatus is positioned.

In a second embodiment, the cutting assembly can be mounted on the lower end of a drill motor connected to a drill string or coiled tubing, with each of two cutting structures being independently rotated by the drill motor. Independent rotation of the cutting structures with a single drill motor can be accomplished by use of a single input, dual output transmission. Rotation of the cutting assembly as a whole is accomplished by rotating the drill string to rotate the drill motor and cutting assembly, or by rotation of the drill motor and cutting assembly with a drill motor. As with the first embodiment, the cutting assembly can be centered on the axis of the well bore or casing within which the apparatus is positioned.

In a third embodiment, a drill motor is fitted with clamp-on eccentric stabilizers which offset the axis of the drill motor from the axis of the borehole or casing. The drill motor is connected to a drill string or coiled tubing. Where the drill motor is connected to a rotatable drill string, the eccentric stabilizers contact the walls of the borehole or casing. Where the drill motor is connected to coiled tubing, the motor and stabilizers can be located within a rotatable housing which essentially aligns with the borehole or casing axis. In either case, the cutting assembly consists of a single cutting structure driven by the drill motor. This cutting structure can be aligned with the axis of the drill motor, with the result that the cutting assembly is offset from the axis of the well bore or casing. In this embodiment, the single cutting structure is rotated by the drill motor, while rotation of the motor and cutting assembly as a whole is accomplished by rotating the drill string, or by rotating the motor and cutting assembly with a drill motor.

In any of the embodiments where rotation of the apparatus is accomplished by a drill motor, a second drill motor may be used, or a secondary drive off a single drill motor may rotate the apparatus.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
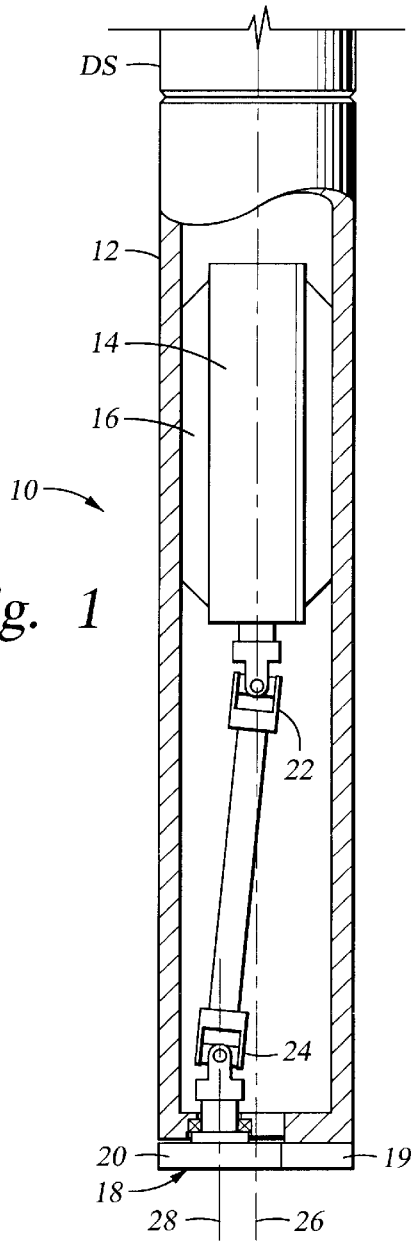
FIG. 1 is a schematic longitudinal section view of a first embodiment of the apparatus of the present invention.

As shown in FIG. 1, a first embodiment of the tool 10 of the present invention includes a housing 12, a drill motor 14, and a cutting assembly 18. The housing 12 is connectable to the lower end of a drill string or coiled tubing DS. The housing 12 is rotatable about its longitudinal axis 26, either by rotation of the drill string DS, or by being driven by a separate drill motor (not shown), above the housing 12 on the drill string DS. Alternatively, the housing 12 can be rotated by a secondary drive (not shown) off the drill motor 14. The drill motor 14 can be driven by drilling fluid, or by compressed air, or by any other suitable means. The drill motor 14 can be mounted, and centered if desired, in the housing 12 by means of one or more mounts or centralizers 16.

The cutting assembly 18 is mounted on the lower end of the housing 12, for rotation by means of rotation of the housing 12. The longitudinal axis of rotation 26 of the housing 12 is also the longitudinal axis of rotation 26 of the cutting assembly 18. The cutting assembly 18 comprises a first cutting structure 19, which is fixedly mounted to the lower end of the housing 12, and a second cutting structure 20, which is rotatably mounted to the lower end of the housing 12. The longitudinal axis of rotation 26 of the housing 12 and the cutting assembly 18 is also the longitudinal axis of rotation 26 of the first cutting structure 19. The second cutting structure 20 is independently rotatable about its longitudinal axis 28, which is parallel to, but laterally offset from, the longitudinal axis 26 of the cutting assembly 18. The second cutting structure 20 is driven by the drill motor 14, via one or more coupling mechanisms or universal joints 22, 24 if required. The second cutting structure 20 spans the longitudinal axis 26 of the cutting assembly 18, since the longitudinal axis 26 of the cutting assembly 1 8 passes through the second cutting structure 20.

Figure 2:
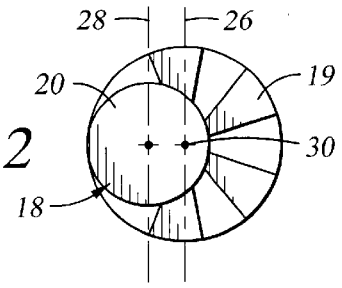
FIG. 2 is a schematic end view of the cutting assembly mounted on the lower end of the apparatus shown in FIG. 1.

As shown in FIG. 2, the first cutting structure 19 can incorporate a plurality of blades, or it could be a crescent shaped structure with a flat lower face similar to the lower face shown on the second cutting structure 20. In either case, the first cutting structure 19 is dressed with cutting elements. The axis of rotation 26 of the housing 12, the cutting assembly 18, and the first cutting structure 19 passes through the center point 30 of the lower face of the cutting assembly 18. The second cutting structure 20 can be a circular structure with a flat lower face as shown, or it could incorporate blades similar to the blades shown on the first cutting structure 19. In either case, the second cutting structure 20 is dressed with cutting elements. The axis of rotation 28 of the second cutting structure 20 is parallel to, but laterally offset from, the axis of rotation 26 of the cutting assembly 18. Therefore, although the second cutting structure 20 spans the longitudinal axis 26 of the cutting assembly 18, the axis of rotation 28 of the second cutting structure 20 does not pass through the center point 30 of the lower face of the cutting assembly 18. Instead, as the second cutting structure 20 independently rotates about its axis 28, the cutting elements on the second cutting structure 20 continually sweep the center point 30. It can be seen, therefore, that there is no point on the lower face of the cutting assembly 18 which has a zero cutting speed at any time.

Figure 3:
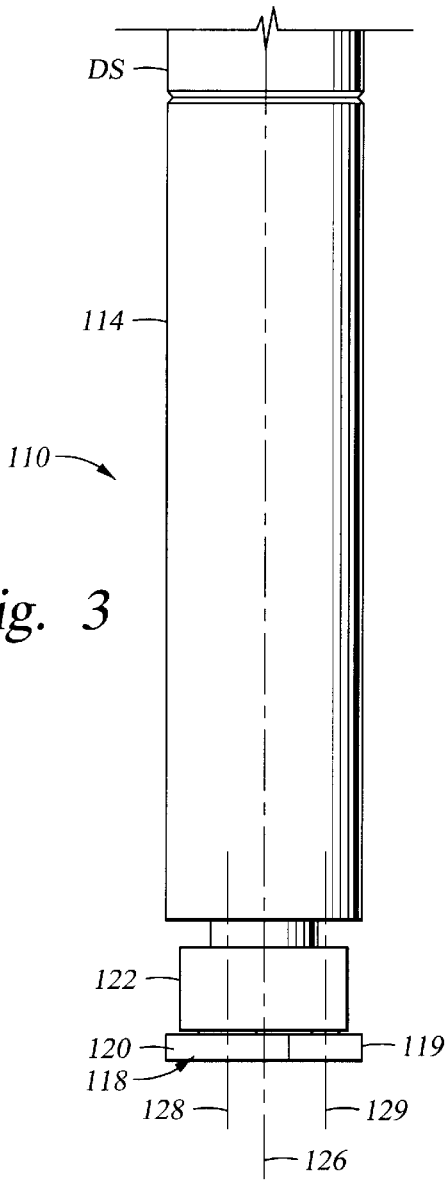
FIG. 3 is a schematic longitudinal section view of a second embodiment of the apparatus of the present invention.

As shown in FIG. 3, a second embodiment of the tool 110 of the present invention includes a drill motor 114, and a cutting assembly 118. The drill motor 114 is connectable to the lower end of a drill string or coiled tubing DS. The drill motor 114 is rotatable about its longitudinal axis 126, either by rotation of the drill string DS, or by being driven by a separate drill motor (not shown), above the drill motor 114 on the drill string DS. Alternatively, the drill motor 114 can be rotated by a secondary drive (not shown) off the drill motor 114. The drill motor 114 can be driven by drilling fluid, or by compressed air, or by any other suitable means.

The cutting assembly 118 is mounted on the lower end of the tool 110, for rotation as a unit, by means of rotation of the entire drill motor 114, as described above. The longitudinal axis of rotation 126 of the drill motor 114 is also the longitudinal axis of rotation 126 of the entire cutting assembly 118. The cutting assembly 118 comprises a first cutting structure 119, which is independently rotatably mounted to the lower end of the tool 110, and a second cutting structure 120, which is also independently rotatably mounted to the lower end of the tool 110. The first cutting structure 119 is independently rotatable about its longitudinal axis 129, which is parallel to, but laterally offset from, the longitudinal axis 126 of the cutting assembly 118. The first cutting structure 119 is driven by the drill motor 114, via one output of a single input, dual output transmission 122. The second cutting structure 120 is independently rotatable about its longitudinal axis 128, which is parallel to, but laterally offset from, the longitudinal axis 126 of the cutting assembly 118. The second cutting structure 120 is also driven by the drill motor 114, via a second output of the single input, dual output transmission 122. Alternatively, each cutting structure 119, 120 could be independently driven by a separate drill motor or air motor. The second cutting structure 120 spans the longitudinal axis 126 of the cutting assembly 118, since the longitudinal axis 126 of the cutting assembly 118 passes through the second cutting structure 120.

Figure 4:
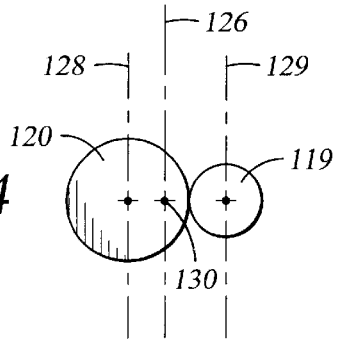
FIG. 4 is a schematic end view of the cutting assembly mounted on the lower end of the apparatus shown in FIG. 3.

As shown in FIG. 4, the first cutting structure 119 can be a circular structure with a flat lower face as shown, or it could incorporate blades similar to the blades shown on the first cutting structure 19 in FIG. 2. In either case, the first cutting structure 119 is dressed with cutting elements. The axis of rotation 126 of the drill motor 114 and the cutting assembly 118 passes through the center point 130 of the lower face of the cutting assembly 118. The axis of rotation 129 of the first cutting structure 119 is parallel to, but laterally offset from, the axis of rotation 126 of the cutting assembly 118. The second cutting structure 120 also can be a circular structure with a flat lower face as shown, or it could incorporate blades similar to the blades shown on the first cutting structure 19 in FIG. 2. In either case, the second cutting structure 120 is dressed with cutting elements. The axis of rotation 128 of the second cutting structure 120 is parallel to, but laterally offset from, the axis of rotation 126 of the cutting assembly 118. Therefore, although the second cutting structure 120 spans the longitudinal axis 126 of the cutting assembly 118, the axis of rotation 128 of the second cutting structure 120 does not pass through the center point 130 of the lower face of the cutting assembly 118. Instead, as the second cutting structure 120 independently rotates about its axis 128, the cutting elements on the second cutting structure 120 continually sweep the center point 130. It can be seen, therefore, that there is no point on the lower face of the cutting assembly 118 which has a zero cutting speed at any time.

Figure 5:
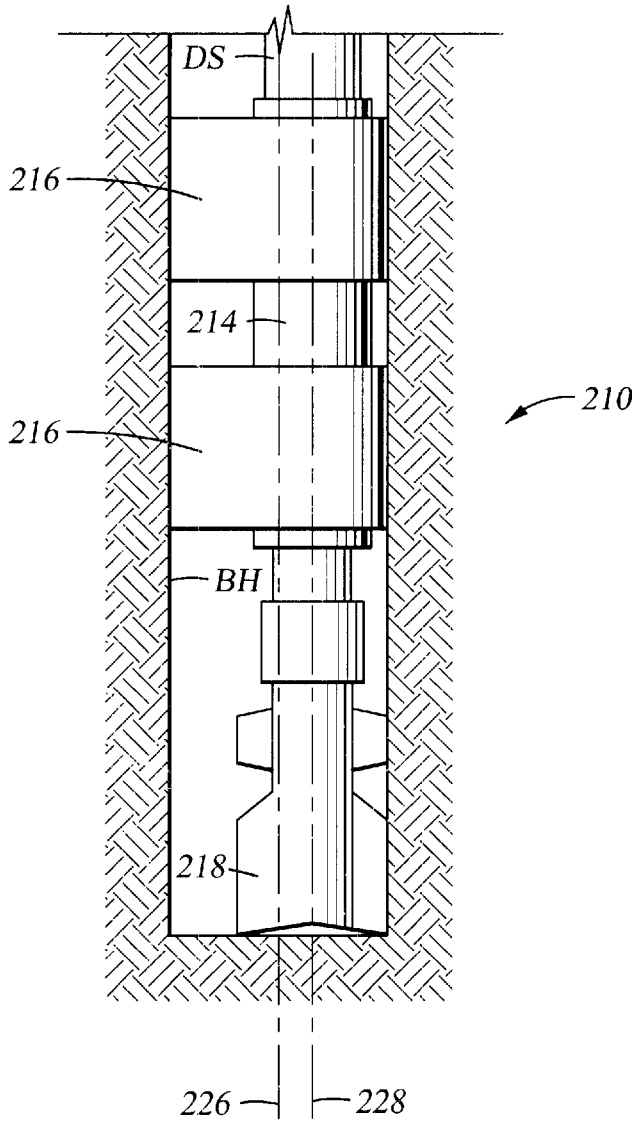
FIG. 5 is a schematic longitudinal section view of a third embodiment of the apparatus of the present invention.

As shown in FIG. 5, a third embodiment of the tool 210 of the present invention includes a drill motor 214, and a cutting assembly 218. It can also include a housing which essentially aligns with the borehole or casing BH within which the apparatus is positioned. The housing or drill motor 214 is connectable to the lower end of a drill string or coiled tubing DS. The tool 210 is rotatable about its longitudinal axis 226, either by rotation of the drill string DS. or by being driven by a separate drill motor (not shown), above the tool 210 on the drill string DS. Alternatively, the tool 210 can be rotated by a secondary drive (not shown) off the drill motor 214. The drill motor 214 can be driven by drilling fluid, or by compressed air, or by any other suitable means. Whether or not the housing is present, the drill motor 214 is held in a position laterally offset from the longitudinal axis of the tool 210 by one or more eccentric stabilizers 216, which can be the clamp-on type.

The cutting assembly 218 comprises a single cutting structure which is rotatable about its longitudinal axis 228, which is parallel to, but laterally offset from, the longitudinal axis 226 of the tool 210. The cutting structure 218 is driven about its axis 228 by the drill motor 214. Further, the cutting structure 218 is rotated about the axis 226 of the tool 210 by rotation of the tool 210, either by turning of the drill string DS, by use of a second drill motor (not shown), or by means of a secondary drive (not shown) off the drill motor 214. The cutting structure 218 spans the longitudinal axis 226 of the tool 210, since the longitudinal axis 226 of the tool 210 passes through the cutting structure 218.

Figure 6:
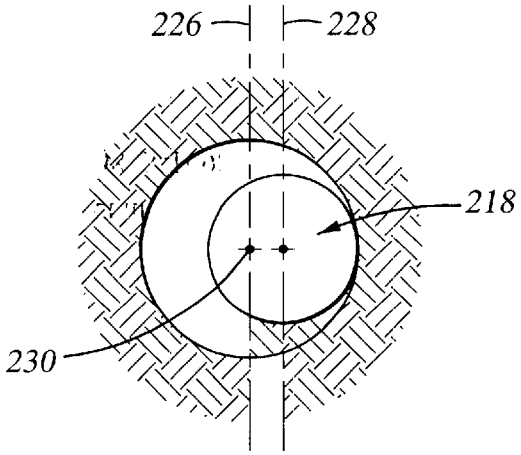
FIG. 6 is a schematic end view of the cutting assembly mounted on the lower end of the apparatus shown in FIG. 5.

As shown in FIGS. 5 and 6, the cutting structure 218 can incorporate a plurality of blades, or it could have a flat lower face similar to the lower face shown on the second cutting structure 20 in FIG. 2. In either case, the cutting structure 218 is dressed with cutting elements. The axis of rotation 228 of the cutting structure 218 is parallel to, but laterally offset from, the axis of rotation 226 of the tool 210. Therefore, although the cutting structure 218 spans the longitudinal axis 226 of the tool 210, the axis of rotation 228 of the cutting structure 218 does not pass through the center point 230 of the lower face of the tool 210. Instead, as the cutting structure 218 independently rotates about its axis 228, the cutting elements on the cutting structure 218 continually sweep the center point 230. It can be seen. therefore, that there is no point on the lower face of the cutting assembly 218 which has a zero cutting speed at any time.

Any of these embodiments, by preventing the occurrence of a zero speed point anywhere on the lower face of the cutting assembly 18, 118, 218, prevents coning of the matrix material and deterioration of the central portion of the face of the cutting assembly 18, 118, 218.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A tool for removing downhole material from a well bore, comprising:

a cutting structure adapted for connection to a lower end of a drill string for positioning in the well bore, said cutting structure being rotatable about its longitudinal axis;

wherein said cutting structure is also rotatable about the longitudinal axis of said tool;

wherein said longitudinal axis of said cutting structure is parallel to, but laterally offset from, said longitudinal axis of said tool; and wherein said longitudinal axis of said tool passes through said cutting structure;

a housing connectable to the lower end of the drill string for rotation;

means drivably connecting the drill string to said housing for rotating said housing; and a drill motor mounted within said rotatable housing;

wherein said cutting structure is rotatably mounted to a lower end of said rotatable housing, said cutting structure being drivably engaged by said drill motor.

2. A tool as recited in claim 1, wherein said means drivably connecting the drill string to said housing fixedly attaches said housing to the drill string for rotation by rotation of the drill string.

3. A tool for removing downhole material from a well bore, comprising:

a cutting assembly adapted for connection to a lower end of a drill string for positioning in the well bore, said cutting assembly being rotatable about its longitudinal axis, said cutting assembly including first and second cutting structures, each said cutting structure being adapted for rotation about its respective longitudinal axis, at least one of said first and second cutting structures being adapted for rotation by at least one drill motor mounted for rotation with said cutting assembly;

a housing connected to the drill string, said cutting assembly being mounted to said housing; and means drivably connecting the drill string to said housing for rotating said housing;

wherein said first and second cutting structures, in combination. extend substantially across the diameter of a louver end of said cutting assembly;

wherein said longitudinal axis of said second cutting structure is parallel to, but laterally offset from, said longitudinal axis of said cutting assembly; and wherein said longitudinal axis of said cutting assembly passes through said second cutting structure.

4. A tool as recited in claim 3, wherein:

said first cutting structure is fixedly mounted to said lower end of said rotatable housing; and said second cutting structure is rotatably mounted to said lower end of said rotatable housing, said second cutting structure being drivably engaged by said at least one drill motor.

5. A tool as recited in claim 4, wherein said means drivably connecting the drill string to said housing fixedly attaches said housing to the drill string for rotation by rotation of the drill string.

6. A tool as recited in claim 3, wherein:

said first cutting structure is drivably engaged by said at least one drill motor for rotation about its longitudinal axis; and said second cutting structure is drivably engaged by said at least one drill motor for rotation about its longitudinal axis.

7. A tool as recited in claim 6, wherein said at least one drill motor is fixedly attached to the drill string for rotation by rotation of the drill string.

8. A tool as recited in claim 6, further comprising a single input, dual output drive member for driving said first and second cutting structures with said at least one drill motor.

9. A tool for removing downhole material from a well bore, comprising:

a housing adapted for connection to a lower end of a work string for positioning in the well bore, said housing being rotatable about its longitudinal axis;

means on the work string for drivably rotating said housing;

a cutting assembly mounted to a lower end of said housing, said cutting assembly including first and second cutting structures, said first cutting structure being fixed mounted to said lower end of said rotatable housing, said second cutting structure being rotatable about its longitudinal axis relative to said housing; and a drill motor fixedly mounted within said rotatable housing, said second cutting structure being drivably engaged by said drill motor for rotation relative to said housing;

wherein said first and second cutting structures, in combination. extend substantially across the diameter of said cutting assembly;

wherein said longitudinal axis of said second cutting structure is parallel to, but laterally offset from, said longitudinal axis of said housing; and wherein said longitudinal axis of said housing passes through said second cutting structure.

10. A tool as recited in claim 9, wherein said means for drivably rotating fixedly attaches said housing to the work string for rotation by rotation of the work string.

* * * * *